US005633648A

United States Patent [19]

Fischer

[11] Patent Number: 5,633,648

[45] Date of Patent: May 27, 1997

[54] RF CURRENT-SENSING COUPLED ANTENNA DEVICE

[75] Inventor: Joseph F. Fischer, Manhattan Beach, Calif.

[73] Assignee: Fischer Custom Communications, Inc., Torrance, Calif.

[21] Appl. No.: 508,716

[22] Filed: Jul. 28, 1995

[51] Int. Cl.[6] ..... H01Q 7/08

[52] U.S. Cl. ..... 343/788; 343/742; 343/856

[58] Field of Search ..... 343/788, 742, 343/720, 856, 741, 787, 789

[56] References Cited

U.S. PATENT DOCUMENTS 3,278,937 10/1966 Leydorf ..... 393/856

3,646,562 2/1972 Acker et al. ..... 343/720

4,622,558 11/1986 Corum ..... 343/742

*Primary Examiner*—Donald T. Hajec

*Assistant Examiner*—Tho Phan

*Attorney, Agent, or Firm*—Ladas & Parry

[57] ABSTRACT

An apparatus for, and method of, replacing conventional antennas which intercept radio frequency fields and develop electrical signals for input to an RF receiver. The invention eliminates the use of antennas by taking advantage of the fact that any electrical conductor or surface develops significant current when its length is approximately 0.1 wavelength long or longer of an intercepted RF field. The RF current-sensing coupled antenna device, employing the principles of an instrument transformer, transforms the current in a wire filament or metallic surface and conveys it to a receiver. The useful frequency range that has been demonstrated for the coupled antenna device is 100 kHz to 2 GHz.

20 Claims, 3 Drawing Sheets

RF CURRENT-SENSING COUPLED ANTENNA DEVICE

BACKGROUND OF THE INVENTION

1. Field of the Invention

This invention relates to an apparatus for replacing conventional antennas which intercept radio frequency fields and develop electrical signals for input to a receiver.

2. Brief Description of the Prior Art

A conventional antenna utilizes current being developed on its structure when exposed to a radio frequency (RF) field intensity. This current, in turn, develops an RF signal voltage which is fed to the input of an RF receiver. Equation (1) is one expression which validates this:

$$V=Iz=eh \quad (1)$$

where:

V=Voltage developed by an antenna at the input of a receiver (in volts)

I=Current developed in an antenna at the input of a receiver (in amperes)

Z=Impedance of an antenna (ohms)

e=Impinging field intensity (in volts/meter)

h=Effective height of an antenna in meters, assuming a ground based signal source This equation identifies that a conventional antenna, when exposed to a field intensity, will develop a current which defines a signal input to a receiver. Obviously, conventional antennas are available in many forms and sizes. The lower the frequency of signal to be received, the longer the antenna required to properly develop a signal for the receiver, and therefore in some low frequency applications the antenna becomes large, perhaps difficult to mount to a nearby structure, and may require a significant outlay of funds for the purchase of a proper antenna and its mounting hardware.

In another field of technology, related only in the environment involving RF energy and associated RF electrical signals, instrument transformers, or devices commonly referred to as RF current probes, are well known. These devices are designed to be used in laboratory instrumentation applications for purposes of taking measurements. That is, in the past, current probes have been typically used to monitor current flowing in a unit under test, or has been used to inductively couple current into a unit under test. Such testing is typically required during electromagnetic interference testing required by civil regulatories like the Federal Communications Commission, the European Economic Community, and the military when certifying a piece of equipment or confirming conformance to standards. Typically, the current developed by the devices of this type is measured to see if it exceeds or does not exceed (as specified) a certain prescribed current value.

The known RF current probe may be employed as a test instrument device to detect RF current developed in any metallic wire or surface. Generally, such RF current probes, or instrument transformers, may be constructed according to two different embodiments.

One embodiment comprises a toroidal magnetic core and winding, the winding representing a secondary winding of a transformer. A single metallic wire passing through the center of the toroid, often referred to as a "single turn", acts as a primary winding. The "single turn" primary can be any electrical conductor capable of carrying current. The secondary winding, when terminated by an impedance, develops a voltage across that impedance. The voltage may then be read on a voltmeter, and, since the impedance is known, the current is readily derivable.

A second embodiment of an RF current probe is a half-toroid transformer (i.e. a toroid cross-sectioned along a plane containing the axis of the toroid) having a winding on the half-toroid acting as a secondary. A metallic surface, against which the cross-sectional surface of the half-toroid is contacting, acts as the primary winding. The end surfaces of the half-toroid are placed against the metallic surface for maximum sensitivity.

The present invention combines RF antenna technology with RF current probe technology in a heretofore unknown manner to eliminate conventional antennas utilizing existing wires or surfaces of metallic structures.

SUMMARY OF THE INVENTION

The present invention eliminates the use of antennas by taking advantage of the fact that any electrical conductor or surface develops significant current when its length is approximately 0.1 wavelength long or longer of an intercepted RF field. The present invention accomplishes this goal by providing an instrument transformer capable of transforming the current in a wire filament or metallic surface and conveying it to a receiver. Hereinafter, the instrument transformer device employed for this purpose will be referred to as an RF current sensing coupled antenna device, or, for convenience of description, simply "coupled antenna device". The useful frequency range that has been demonstrated for the coupled antenna device is 100 kHz to 2 GHz.

A metallic conductor such as: 1) a flag pole; 2) a supporting guy wire; 3) the metal surfaces of an architectural structure; or 4) the hull or mast of a ship will generate an RF current when exposed to an RF field intensity.

The present invention utilizes the detection of RF current, developed in any metallic wire, rod, bar, slab, strip, or surface, to replace a conventional antenna.

In one of the preferred embodiments of the invention, the coupled antenna device is a toroidal instrument transformer with the primary winding consisting of any wire or metallic structure at least 0.1 wavelength long of the RF field desired to be intercepted. The primary wire or metallic structure can be connected directly to a fastener located in the earth or to an architectural structure. No impedance termination or special treatment of the primary is required. The secondary is a wire winding wound around the toroidal magnetic core of the coupled antenna device.

Another preferred embodiment is that of a magnetic core consisting of a half-toroid, as hereinbefore described, or U-shaped rectangular bar of magnetic material with its secondary winding wound around the magnetic core. The primary winding consists of a metallic surface which can be a portion of a vehicle, ship, or an architectural structure. These surfaces develop current and a magnetic field when exposed to RF signal strengths. When the ends of the toroidal core half, or U-shaped bar, are placed in close proximity to the surface, the magnetic flux produced by the metallic surface develops an output voltage in the secondary of the coupled antenna device sufficient to operate an RF receiver.

The secondary voltage output ($E_{out}$) in volts compared to the primary current ($I_{input}$) in amperes is defined as the transfer impedance ($Z_T$) in ohms, according to the relationship expressed in Equation (2).

$$Z_T=E_{out}/I_{input} \quad (2)$$

The greater the value of $Z_T$, the greater the magnitude of the output voltage for a given amount of current being detected.

The relationship between the minimum signal voltage required by an RF receiver and the field intensity is dependent upon the value of the coupled antenna device transfer impedance $Z_T$. The greater the transfer impedance, the smaller the field intensity required to develop an acceptable voltage to operate an RF receiver.

The magnitude of voltage output of the coupled antenna device when clamped around a conductor, or pressed against a metallic surface that is approximately 0.1 wavelength long or longer, is sufficient to operate most radio frequency receivers over the frequency range of 100 kHz to 2 GHz.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
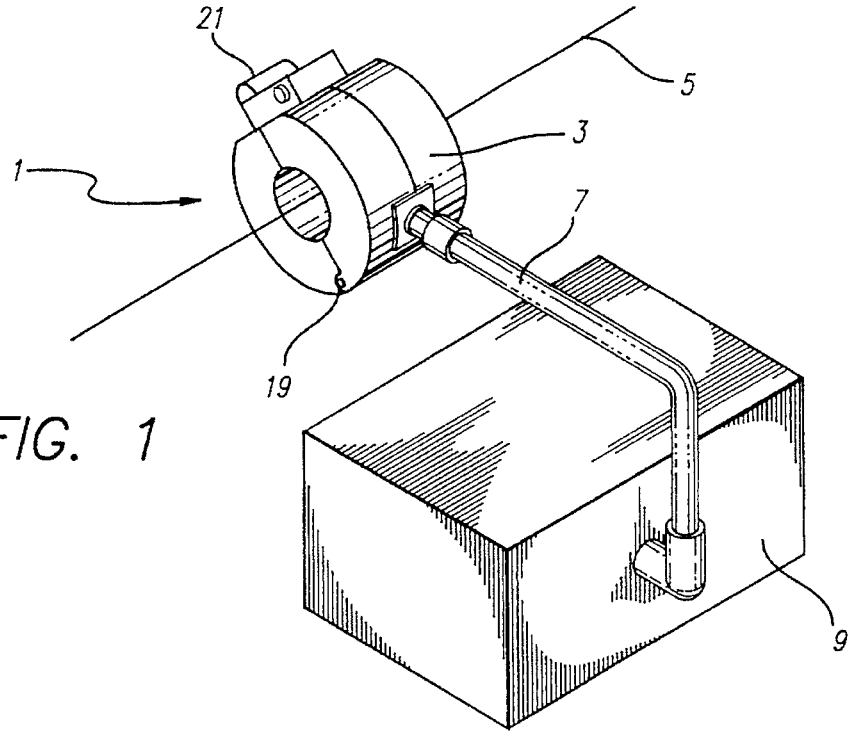
FIG. 1 is a conceptual coupled antenna device installation employing a full toroidal configuration.

FIG. 1 is a conceptual coupled antenna device installation. A coupled antenna device 1 having a toroidal secondary 3 is clamped around a conductor 5 acting as a primary. A 50 ohm cable 7 couples the output of secondary 3 to the input of an RF receiver 9.

An example, using a typical measured transfer impedance to demonstrate the effectiveness of the invention is given as follows. A coupled antenna device 1 having a measured transfer impedance of 5 ohms or more over the frequency range of 3 MHz to 1 GHz is used in the example. Using Equation 2, and specifying that the required signal voltage to operate the receiver must be at least 10 microvolts, the signal current must be 2 microamperes. The following example demonstrates the mechanism for generating 2 microamperes in the conductor 5 being used as the primary winding.

A metallic structure 0.1 wavelength long at 10 MHz, in theory, is physically 3 meters in length. The effective height of a monopole antenna is approximately one-half its theoretical physical length. This, then, identifies that the metallic structure (conductor 5) must have a physical length of 3 meters in order to have an effective electrical length of 1.5 meters. Many metallic structures in one's environment, especially in a vehicle or on a ship, will meet this physical requirement.

Equation (1) may now be used to solve for the field intensity to achieve 10 microvolts of signal. Equation (1) computes the field intensity to be 10 microvolts divided by 1.5 meters, or about 7 microvolts/meter. This is a very small field intensity and of realistic value.

A 0.1 wavelength monopole antenna will have an input impedance of at least 5 ohms. Then, solving for current: 10 microvolts divided by 5 ohms yields 2 microamperes. In reality, the monopole equivalent antenna will most likely be grounded. This will result in a lower impedance which will thus result in more than 2 microamperes of current. This example is meant to illustrate that when using realistic parameters, a viable performance is achieved.

Referencing FIGS. 1 and 2A–2C, the winding of the toroidal secondary 3 is wound on a magnetic core 13 to increase sensitivity. Various magnetic core materials, and the number of turns of the secondary govern not only the magnitude of $Z_T$ but the useable frequency range of optimum sensitivity.

The physical size of a toroidal coupled antenna device is a function of the maximum diameter of primary conductor 5 that has to pass through its aperture 4.

Figure 2A:
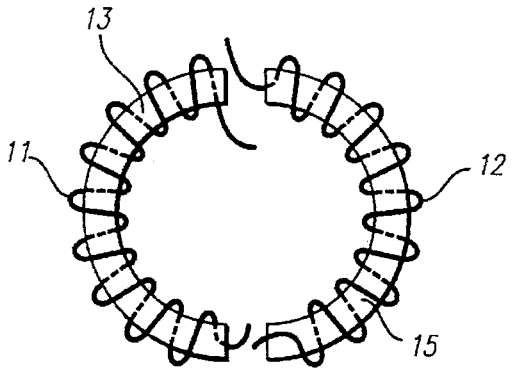
FIGS. 2A–2C show multiple views of a typical clamp-on (hinged) coupled antenna device secondary, FIG. 2B showing the housing in cross section to expose the interior of the secondary, and FIG. 2C being a cross section taken along the line 2C—2C in FIG. 2B.
Figure 2B:
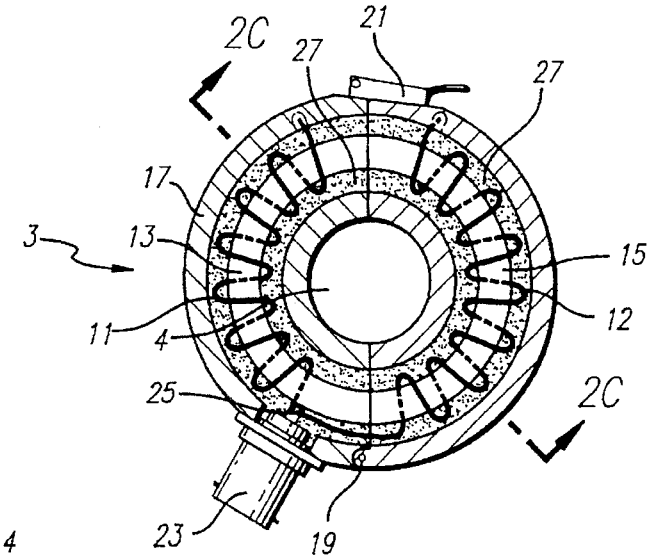
Figure 2C:
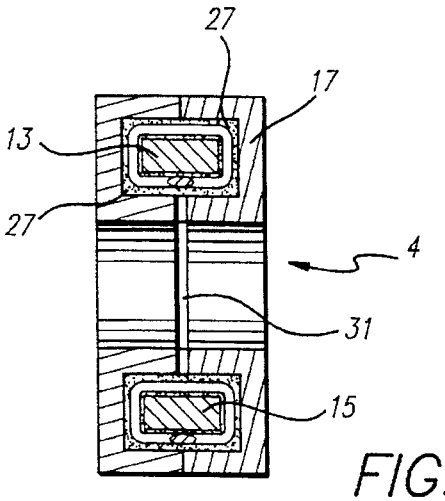

FIGS. 1 and 2A–2C show multiple views of a typical clamp-on (hinged) coupled antenna device secondary 3, FIG. 2B showing the conducting non-magnetic housing 17 in cross section to expose the interior of the coupled antenna device 3 including secondary windings 11, 12, and FIG. 2C being a cross section taken along the line 2C—2C in FIG. 2B. The views show the shielded housing 17 which eliminates the effect of electric field pickup.

FIG. 2C, in particular, shows that the outer electric field shield and housing 17 has an air gap 31, which is required in order to prevent forming a shorted tertiary turn around the secondary winding 11, 12. If no air gap 31 were present, the shorted turn of the shield 17 would destroy the operability of the coupled antenna device 1.

FIG. 2B is a view showing the shield/housing 17 cutaway, exposing the two-piece magnetic toroidal core 13, 15 and a typical secondary winding 11, 12. The primary winding is not shown in this drawing. It would consist of a single conductor passing through the aperture 4.

The core is made of two separate core segments 13 and 15 so as to permit the secondary 3 to hinge open and accommodate a primary conductor 5 within aperture 4. A hinge 19 is provided on the bottom as shown in FIG. 2B, while a releasable latch 21 is shown at the top. The secondary winding 11, 12 is loose at the bottom of coupled antenna device 1 to avoid strain when the latch 21 is opened and the two core halves 13, 15 are hinged apart.

The housing, or outer shield, 17 may be made of aluminum or brass, and, typically, a BNC female connector 23 is mounted on housing 17, the connector 23 having a terminal 25 for connection of the secondary windings 11, 12.

The core segments 13, 15 are centered in the housing 17 and supported within the housing 17 by an annular shaped insulation member 27.

Figure 3:
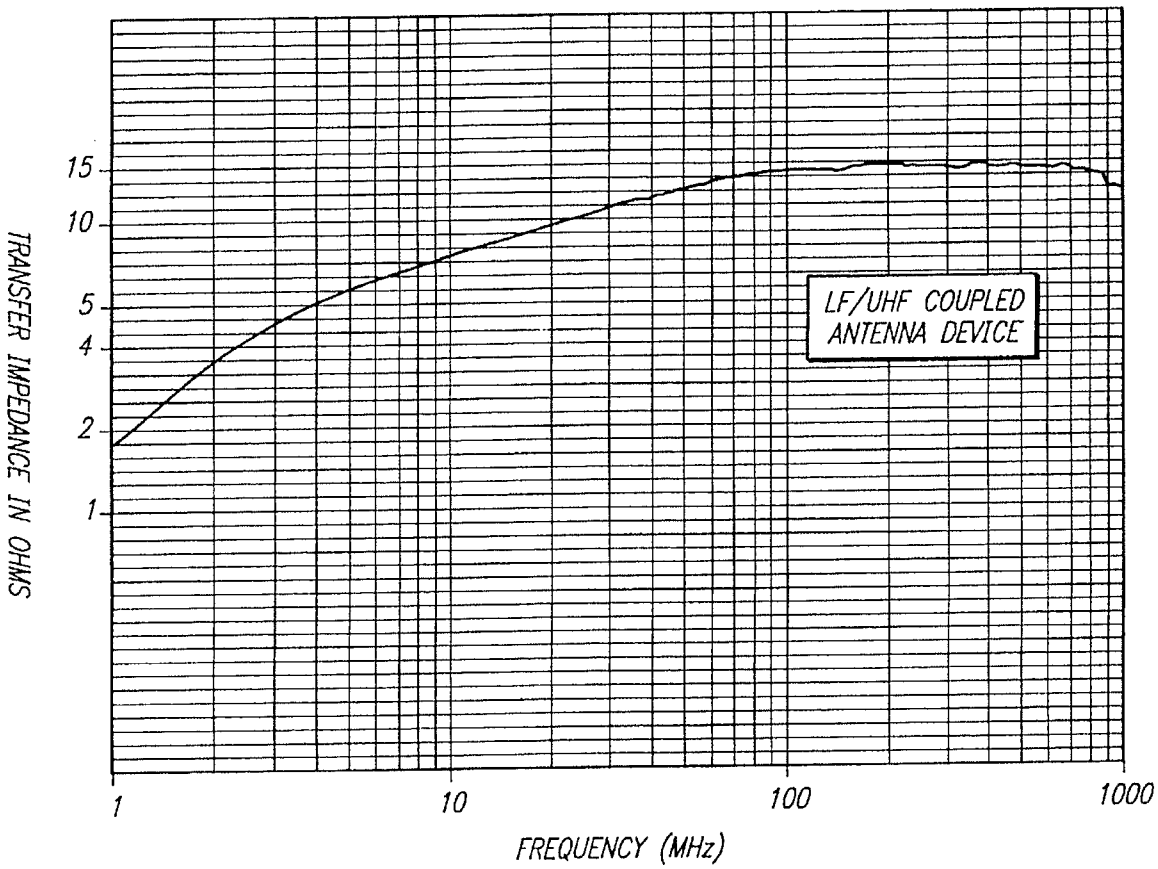
FIG. 3 is a graph of measured transfer impedance of a clamp-on coupled antenna device.

FIG. 3 is a graph of measured transfer impedance of a clamp-on coupled antenna device showing that its frequency range extends from 1 MHz to 1 GHz for transfer impedances ranging from about 2 ohms to about 15 ohms.

When a metallic structure is large and assumes a surface, like a sheet of metal, the configuration of the coupled antenna device changes. For such structures, the coupled antenna device 41 (FIGS. 4A and 4B) is embodied as one-half of a toroid with the winding 49 on the half-toroid acting as a secondary of the coupled antenna device, and the metallic surface carrying the current acting as the primary winding. The ends 41A, 41B of the half-toroid coupled antenna device 41 are placed flat adjacent the surface for maximum sensitivity and, where possible and convenient, no more than 0.05 wavelengths from an end or edge of the metallic surface. This placement stems from the fact that RF currents have been shown to concentrate on the edges of surfaces, making the output of the coupled antenna device larger due to increased current density.

Figure 4A:
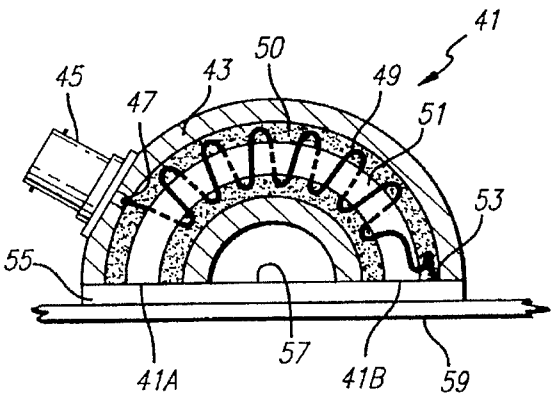
FIGS. 4A and 4B shows a typical surface coupled antenna device employing a half toroidal configuration.
Figure 4B:
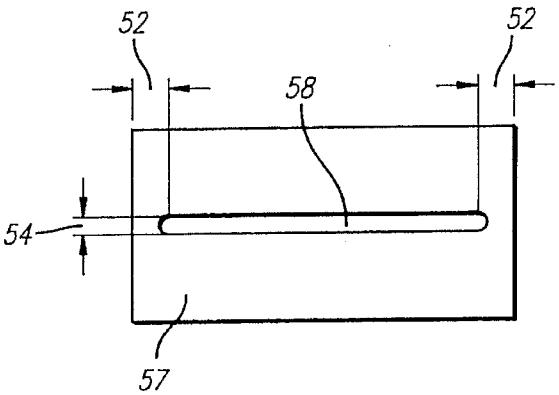

FIGS. 4A and 4B shows a typical surface coupled antenna device 41. These figures show the external shielded housing 43 employed to eliminate electric field pickup. Shown also is the half toroidal core 51 and a secondary winding 49 wound thereabout. The sensitivity of the coupled antenna device is controlled by design of the core 51, windings 49, and the width of the air gap 58 in the copper layer 57 on the dielectric, phenolic, base 55 of the coupled antenna device 41. The dielectric base 55 of the coupled antenna device 41 is placed directly upon the metallic surface 59 carrying the current to be monitored. The maximum sensitivity of the coupled antenna device 41 is achieved when the long axis of the coupled antenna device 41 is perpendicular to the current flow in the surface 59.

Figure 5:
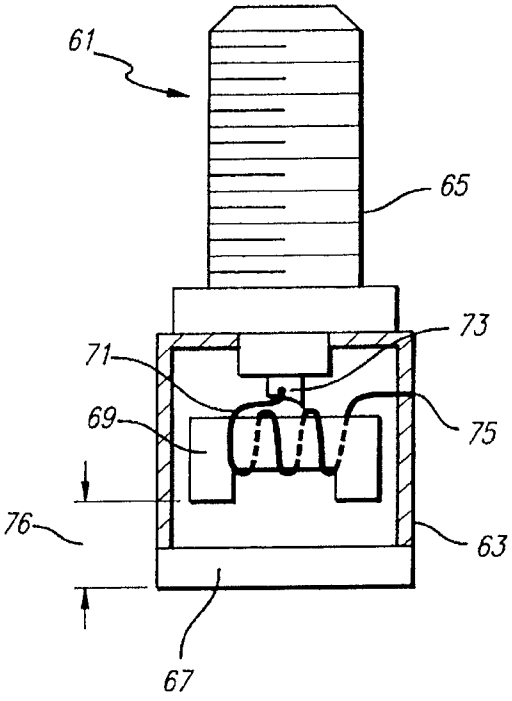
FIG. 5 shows another version of a surface coupled antenna device which operates to 2.1 GHz, referred to as a miniature skin current coupled antenna device employing a U-shaped bar configuration.

FIG. 5 shows another version of a surface probe which operates to 2.1 GHz, referred to as a miniature skin current coupled antenna device.

Figure 6:
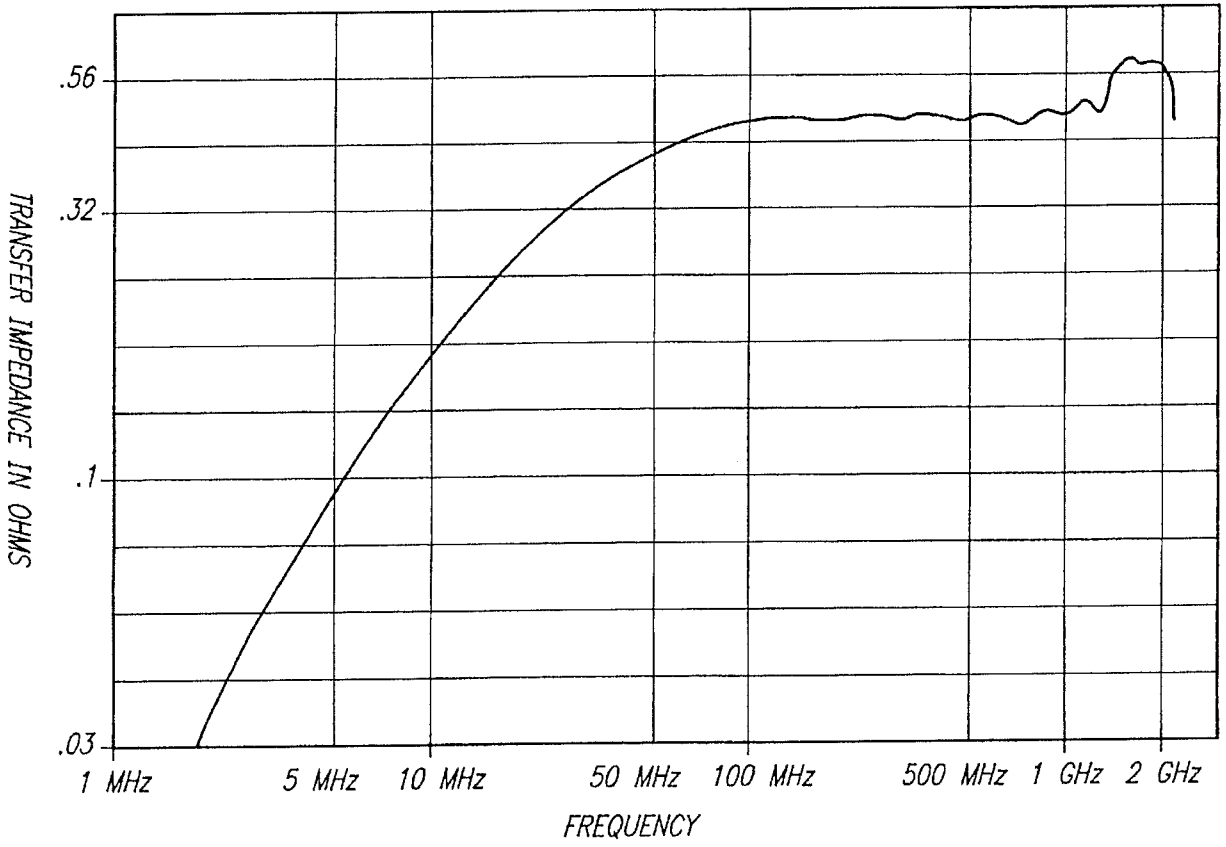
FIG. 6 is a graph of measured transfer impedance, in ohms, of the coupled antenna device shown in FIG. 5.

FIG. 6 is a graph of measured transfer impedance, in ohms, of the coupled antenna device shown in FIG. 5.

The miniature skin current coupled antenna device 61 of FIG. 5 permits quantitative measurements of currents flowing on flat or curved surfaces, wires, and integrated circuits. Surface currents can be optimally sensed quickly and easily, because the coupled antenna device is sensitive to the direction of skin current flow. The core 69 is in the shape of a U and has one end 75 of the secondary winding 71 soldered to the housing 63 which is closed on all sides except the bottom which is closed by an epoxy base 67. The other end of secondary winding 71 is soldered to the center contact 73 of a conventional female SMA connector 65. The ends of the U-shaped core 69 are preferably about 0.1" to 0.25" from the surface being sensed, including epoxy base 67, as shown at 76 in the drawing.

The maximum sensitivity is realized when the axis of the core 69 is in a direction perpendicular to the current flow in the surface being sensed, and when the core 69 is positioned close to an edge of the surface being sensed. The miniature skin current coupled antenna device 61 can be oriented for developing maximum current under the footprint of the housing 63, thereby providing the coupled antenna device and receiver combination with its maximum sensitivity. The dielectric base 67 minimizes the coupled antenna device's disturbance to normal current flow to 10% or less. The transfer impedance varies by approximately ±3 dB for a bandwidth of 30 MHz to 2100 MHz with a magnitude of about 0.4 ohms when used as a surface coupled antenna device, as seen in the graph of FIG. 6 which show typical transfer impedance curves.

The miniature skin current coupled antenna device is useable to lower frequencies with reduced sensitivity. Continuous wave current amplitudes up to 20 amperes and pulse currents up to 200 amperes will not alter the transfer impedance characteristics. The probe dimensions are 0.32 inches wide (front to back in FIG. 5), 0.42 inches long (left to right in FIG. 5), and 0.37 inches high plus the height of connector 65.

Changes may be made in the various elements, components, parts, and assemblies described herein, or in the steps or sequence of steps in the methods described herein, without departing from the spirit and scope of the invention as defined in the following claims.

I claim:

1. An RF current-sensing coupled antenna device for coupling energy, developed in a conductor intercepting an RF field, to the input of an RF receiver, said device comprising:

an outer conducting non-magnetic housing; and a toroidal magnetic core having a central aperture;

a secondary winding wound about said core, said core and secondary winding mounted in and insulated from said housing;

wherein said device couples energy to the input of an RF receiver when placed in relation to the conductor such that the conductor serves as a primary winding having a length of at least 0.1 wavelength of the intercepted RF field.

2. The coupled antenna device as claimed in claim 1, wherein:

the primary winding may be made of any metallic structure including guy wires, flag poles, metal pipe, and architectural steel reinforcing bar;

the primary winding is capable of passing through the aperture of the toroidal magnetic core; and no alteration or impedance matching of the primary winding is necessary.

3. The coupled antenna device as claimed in claim 1, capable of coupling currents in the primary over the frequency range of 100 kHz to 2 GHz.

4. The coupled antenna device as claimed in claim 1, capable of providing a suitable signal to operate an RF receiver when the primary winding has a minimum length of 0.1 wavelength, with measured transfer impedances varying from 1 ohm to 30 ohms over the 100 kHz to 2 GHz frequency range.

5. The coupled antenna device as claimed in claim 4, wherein the magnitude of transfer impedance will provide an RF receiver, to which said device is connected and which has a minimum sensitivity of 5 microvolts, a signal of at least 10 microvolts when the primary winding is exposed to field intensities varying from 1 to 50 microvolts/meter or more.

6. The coupled antenna device as claimed in claim 1, wherein said housing surrounds said toroidal magnetic core and said secondary winding, and said housing has an air gap therein to prevent forming a shorted tertiary turn about said secondary winding.

7. An RF current-sensing coupled antenna device for coupling energy, developed in a conductive surface intercepting an RF field, to the input of an RF receiver, said device comprising:

an outer conducting non-magnetic shield;

a semi-toroidal magnetic core having ends defined by a toroid cross-sectioned along a plane containing the axis of the toroid;

a secondary winding wound about said core, said core and secondary winding mounted in and insulated from said shield;

wherein said device couples energy to the input of an RF receiver when placed in relation to the conductive surface such that said conductive surface serves as a primary winding having a length of at least 0.1 wavelength of the intercepted RF field.

8. The coupled antenna device as claimed in claim 7, capable of providing a suitable signal to operate an RF receiver when the conductive surface, acting as a primary winding, has a minimum length of 0.1 wavelength, and the width of said core is at least one-third the width of the conductive surface.

9. The coupled antenna device as claimed in claim 7, wherein measured transfer impedance values vary from 0.4 ohms to 20 ohms over a frequency range of 100 kHz to 2 GHz, providing an RF receiver having a minimum sensitivity of 5 microvolts, a signal of at least 10 microvolts when the conductive surface is exposed to field intensities varying from 3 to 150 microvolts/meter or more.

10. The coupled antenna device as claimed in claim 7, comprising a metallic layer upon which the ends of said semi-toroidal magnetic core terminate, and said metallic layer is coplanar with a plane containing the axis of said semi-toroidal magnetic core and passing through the center of said semi-toroidal magnetic core, said metallic layer having an air gap therein to prevent forming a shorted tertiary turn about said secondary winding.

11. A method for coupling energy, developed in a conductor intercepting an RF field, to the input of an RF receiver, said method comprising the steps of:

providing an RF receiver;

providing a toroidal magnetic core having a central aperture and a secondary winding wound about said core, said core and secondary winding mounted in and insulated from a conducting non-magnetic housing; and coupling energy to the input of the RF receiver when placing said core, with winding wound thereabout, in relation to the conductor such that the conductor serves as a primary winding having a length of at least 0.1 wavelength of the intercepted RF field.

12. The method as claimed in claim 11, wherein:

the primary winding may be selected from any metallic structure including guy wires, flag poles, metal pipe, and architectural steel reinforcing bar;

the primary winding is capable of passing through the aperture of the toroidal magnetic core; and no alteration or impedance matching of the primary winding is necessary.

13. The method as claimed in claim 11, capable of coupling currents in the primary over the frequency range of 100 kHz to 2 GHz.

14. The method as claimed in claim 11, capable of providing a suitable signal to operate an RF receiver when the primary winding has a minimum length of 0.1 wavelength, with measured transfer impedances varying from 1 ohm to 30 ohms over the kHz to 2 GHz frequency range.

15. The method as claimed in claim 14, wherein the magnitude of transfer impedance will provide an RF receiver, to which said device is connected and which has a minimum sensitivity of 5 microvolts, a signal of at least 10 microvolts when the primary winding is exposed to field intensities varying from 1 to 50 microvolts/meter or more.

16. The method as claimed in claim 11, wherein said housing surrounds said toroidal magnetic core and said secondary winding, and said housing has an air gap therein to prevent forming a shorted tertiary turn about said secondary winding.

17. An method for coupling energy, developed in a conductive surface intercepting an RF field, to the input of an RF receiver, said method comprising:

providing a semi-toroidal magnetic core having ends defined by a toroid cross-sectioned along a plane containing the axis of the toroid;

providing a secondary winding wound about said core, said core and secondary winding mounted in and insulated from a provided conducting non-magnetic shield; and coupling energy to the input of an RF receiver when placing said core, with said secondary winding wound thereabout, in relation to the conductive surface such that said conductive surface serves as a primary winding having a length of at least 0.1 wavelength of the intercepted RF field.

18. The method as claimed in claim 14, capable of providing a suitable signal to operate an RF receiver when the conductive surface, acting as a primary winding, has a minimum length of 0.1 wavelength, and the width of said core is at least one-third the width of the conductive surface.

19. The method as claimed in claim 17, wherein measured transfer impedance values vary from 0.4 ohms to 20 ohms over a frequency range of 100 kHz to 2 GHz, providing an RF receiver having a minimum sensitivity of 5 microvolts, a signal of at least 10 microvolts when the conductive surface is exposed to field intensities varying from 3 to 150 microvolts/meter or more.

20. The method as claimed in claim 17, wherein said semi-toroidal magnetic core comprises a metallic layer upon which the ends of said semi-toroidal core terminate, and said method includes providing an air gap in said metallic layer.

* * * * *